United States Patent [19]

Sickenger

[11] Patent Number: 4,743,180

[45] Date of Patent: May 10, 1988

[54] REVERSIBLE GEAR-TYPE PUMP

[75] Inventor: Kurt Sickenger, Aulendorf, Fed. Rep. of Germany

[73] Assignee: Schwabische Huttenwerke GmbH, Aalen-Wasseralfingen, Fed. Rep. of Germany

[21] Appl. No.: 938,898

[22] Filed: Dec. 8, 1986

[30] Foreign Application Priority Data

Dec. 9, 1985 [DE] Fed. Rep. of Germany ..... 3543488

[51] Int. Cl.[4] ..... F04C 2/18; F04C 15/04

[52] U.S. Cl. ..... 418/32; 418/171

[58] Field of Search ..... 418/32, 166, 171; 417/315

[56] References Cited

U.S. PATENT DOCUMENTS 3,118,387 1/1964 Aldrich ..... 418/32

4,171,192 10/1979 Taylor et al. ..... 418/32

FOREIGN PATENT DOCUMENTS 1553281 9/1969 Fed. Rep. of Germany ..... 418/32

2055883 5/1977 Fed. Rep. of Germany .

*Primary Examiner*—John J. Vrablik

*Assistant Examiner*—Leonard P. Walnoha

*Attorney, Agent, or Firm*—Armstrong, Nikaido, Marmelstein & Kubovcik

[57] ABSTRACT

A reversible gear-type pump providing constant fluid delivery direction on alternating drive direction in which an eccentric ring receiving the outer rotor is pivotal through 180° between two end positions by frictional engagement with the outer rotor wherein the eccentric ring is made contractible as a whole to establish the coupling engagement with the outer rotor and expandable to disengage the coupling engagement. The eccentric ring can be made in one piece from resilient material or can be formed from a plurality of arcuate segments which are pressed together by an annular spring engaging around them.

7 Claims, 2 Drawing Sheets

REVERSIBLE GEAR-TYPE PUMP

BACKGROUND OF THE INVENTION

1. Field of the Invention

The invention relates to a gear-type pump. Gear-type pumps of this type comprise an externally toothed inner rotor which rotates within an internally toothed outer rotor which rotates eccentrically thereto and is in turn mounted in an eccentric ring.

2. Description of the Prior Art

To achieve that the gear-type pump with alternating drive direction maintains its pumping direction the eccentric ring which governs the position of the outer rotor must be pivoted through 180°. The simplest way of doing this is to retain always a certain frictional engagement between the outer surface of the outer rotor and the inner surface of the eccentric ring, the eccentric ring on rotation of the outer rotor thereby always being pressed against an end stop corresponding to the direction of rotation. To avoid the constant friction losses of such a pump it has been proposed in German Auslegeschrift No. 2 055 883 instead of the direction frictional contact between outer rotor and eccentric ring to mount these two parts in each other with a certain play and to provide in the eccentric ring a radially movable piston which is pressed by a spring against the outer rotor and carries a friction body on its surface facing said rotor. The frictional engagement is thus no longer as hitherto directly between the eccentric ring and outer rotor but established indirectly between these components through the intermediary of the friction body.

The aforementioned piston defines an expansion chamber which is connected via a pressure line to the pressure connection of the pump.

In operation of the pump the fluid pressure transmitted from the pressure connection to the expansion chamber acts on the piston, counteracts the spring loading said piston and lifts the friction body out of frictional engagement with the outer rotor. Now, if on reversal of the direction of rotation the pump briefly comes to a stop the delivery pressure drops and thus also the pressure in the expansion chamber, the friction body establishes frictional engagement between the eccentric ring and outer rotor and on starting up in the opposite direction the outer rotor therefore entrains the eccentric ring into its second end position in which the eccentric ring is held by a stop. The delivery pressure building up then again acts in the expansion chamber on the piston so that during operation of the pump the frictional engagement is cancelled.

In spite of its advantages the known pump has the disadvantage that the arrangement of cylinder-like expansion chamber, piston, spring and friction body is relatively complicated and difficult to assemble. In addition, the friction body because of its small dimensions is subjected to high wear. Furthermore, problems are encountered when for example in trucks viscous oil is to be pumped. Moreover, the piston-cylinder arrangement has a considerable radial height and this increases the outer diameter of the eccentric ring and thus also of the pump. Finally, the eccentric ring is limited in its minimum thickness by the piston diameter and the necessary wall thickness.

SUMMARY OF THE INVENTION

Therefore, the invention has as its subject the improvement of the known pump such that it is constructionally simplified, the outer extent necessary for the eccentric ring is reduced and the resistance to wear is increased.

To achieve this object the invention proposes, in a gear-type pump with constant delivery direction on alternating drive direction having a housing with a suction and pressure connection for the fluid to be pumped, an externally toothed inner rotor, an internally toothed outer rotor surrounding the inner rotor, an eccentric ring which receives the outer rotor, is rotatable through 180° and in turn is received in the housing, a coupling means utilizing spring action for establishing a frictional engagement between the outer surface of the outer rotor and a counter-surface connected to the eccentric ring, and a means connected via a pressure line to the pressure connection for disengaging the coupling means as soon as the delivery pressure has exceeded a predetermined value, the improvement in which the eccentric ring subjected to spring pressure has at least one radial slit, to establish the frictional engagement is pressable by the spring tension radially inwardly against the outer surface of the outer rotor and to release the friction engagement is adapted to be lifted off the outer rotor by the fluid with expansion of the radial slit.

The inner face of the eccentric ring is again constructed as counter-surface as was the case with earlier known pumps so that the eccentric ring can be brought directly into frictional engagement with the outer rotor. The eccentric ring according to the invention is however provided with at least one radial slit or, in the case of a plurality of radial slits, made up of segments so that it can be radially contracted and radially expanded. The contraction of the eccentric ring is caused by spring force whilst the expansion takes place by the action of the expansion chamber and by hydrodynamic, lubricating pressures so that when the pump operates and delivers fluid under pressure through the pressure connection said pressure in the expansion chamber and the hydrodynamic pressure due to rotation is employed to expand the eccentric ring so that the frictional engagement between the latter and the outer surface of the outer rotor is cancelled. In this operating state the end position in which the eccentric ring is located is that associated with the particular direction of rotation at that instant.

By returning to the use of said inner surface of the eccentric ring as counter-surface the wear and thus the liability to failure are significantly reduced.

If the eccentric ring is slit only once or has only one continuous slit said ring itself preferably consists of resilient material such as steel, sintered material, aluminium, or even plastic. The spring which is to compress the eccentric ring is then formed by said ring itself so that a spring as separate component can be completely dispensed with. In addition to the one slit permitting compression and expansion of the eccentric ring further slits may be provided not completely extending through the eccentric ring in order to influence the spring characteristic of said ring.

If however the eccentric ring is made up of at least two segments or arc portions said segments in accordance with a further preferred embodiment of the invention are compressed together by an annular spring surrounding them from the outside. This annular spring, which can be inserted into a peripheral groove of the eccentric ring, forms a separate component and is itself easy to assemble.

As expansion element a hydraulic piston may be provided which bends the ends of the slit eccentric ring apart. However, to obtain the expansion a separate component is not absolutely essential: for example, it is possible to form in at least one of the friction faces grooves which are connected to the pressure line. When these grooves are subjected to pressure the eccentric ring is firstly spread apart somewhat. As a result fluid under pressure can flow between the annular gap forming between the eccentric ring and outer rotor and this fluid then expands the eccentric ring.

It is however advantageous in accordance with a preferred embodiment for the expansion chamber to be bordered by the walls of the radial slit. The expansion chamber is thus effective at the point at which the eccentric ring can be widened with the least application of force. An eccentric ring can thus be used which when not loaded by the expansion chamber tightly surrounds the outer rotor, resulting in rapid response to a change in direction and an error-free changeover operation, even with viscous fluids.

The two faces defining the expansion chamber are preferably used as stops to avoid an excessive damaging contraction of the eccentric ring in the non-installed state. Said engaging faces are slightly inclined to each other so that the hydraulic fluid can penetrate between them. To further facilitate the penetration of the hydraulic fluid it is also possible to provide one of the two surfaces of the eccentric ring bordering the expansion chamber with grooves, depressions or the like which are open towards the pressure line.

As a result, these grooves or the like when subjected to fluid are first filled therewith and this initiates the lifting off of the surfaces. The intermediate space existing between the raised surfaces then fills with fluid so that the pressure thereof acts on the complete surface area of the slit walls.

However, in accordance with a preferred embodiment of the invention the inner face of the eccentric ring is recessed.

The resulting recess communicates with the slit and in the end positions of the eccentric ring is disposed opposite the entry of the pressure line so that the pocket-like recess forms part of the expansion chamber. If with the expansion ring contracted this pressure pocket is subjected to pressure it acts radially in the regions adjacent the slit on the eccentric ring and tends to expand said ring radially. When the eccentric ring yields to this action the slit opens, immediately fills with fluid and the full pressure thereof can then act on the walls of the slit. At the same time however the widening of the eccentric ring achieved is promoted by the radially acting pressure component and the hydrodynamic pressure.

The provision of a pressure pocket is, however, also advantageous when said pocket in turn is not directly connected to the pressure line but is subjected to pressure only through the gap between the slit walls because by means of the pressure pocket fluid flows into the expanding annular gap between the outer rotor and eccentric ring and contributes to expanding the eccentric ring away from the outer rotor and thus interrupting the operating condition with frictional engagement as rapidly as possible when this condition is no longer necessary.

Since inputs of the pressure line are disposed at the two end positions of the eccentric ring, according to a further embodiment of the invention a second pressure pocket opposite the first is formed in the inner surface of the eccentric ring. In one end position of the eccentric ring the second pressure pocket lies in front of the mouth of the pressure line associated with the other end position so that the annular space between the eccentric ring and outer rotor is subjected to the action of pressure from two points.

BRIEF DESCRIPTION OF THE DRAWINGS

The invention will be described in more detail hereinafter with the aid of examples of embodiment with reference to the accompanying diagrammatic drawings, wherein.

DESCRIPTION OF THE PREFERRED EMBODIMENTS

Figure 2:
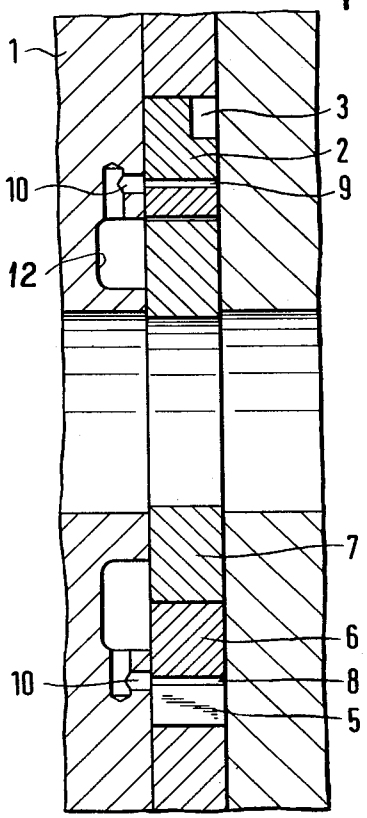
FIG. 2 shows an axial section through the pump of FIG. 1.

Corresponding components are designated throughout the drawings with the same reference numerals. For any component not explained in detail in the description of one of the two embodiments reference is made to the explanation thereof in the description of the other example of embodiment.

Figure 1:
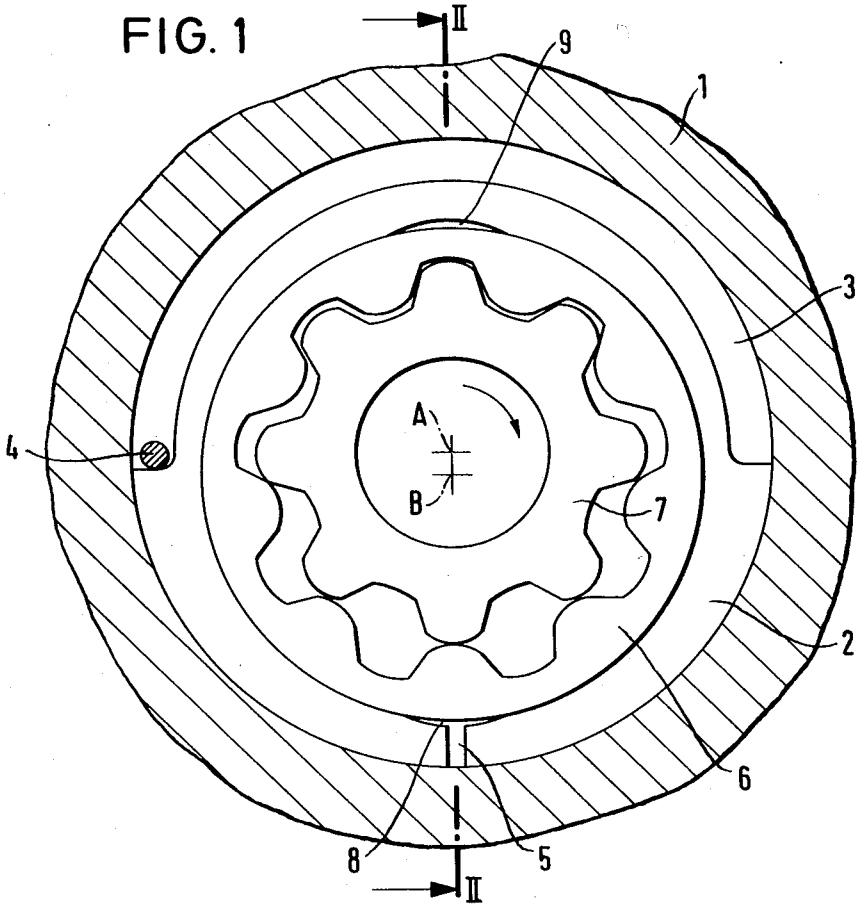
FIG. 1 shows a radial section through an example of embodiment of a gear-type pump according to the invention.

FIG. 1 shows an example of embodiment of the gear-type pump according to the invention in radial section and comprises a housing 1 having a cylindrical chamber into which an eccentric ring 2 fits. Said eccentric ring 2, the cylindrical outer surface of which is centered on the axis A, has a substantially cylindrical inner bore whose centre axis B is off-set with respect to the centre axis A. Received in the eccentric bore of the eccentric ring 2 is an outer rotor 6 which has a cylindrical outer surface which is substantially complementary to the inner surface of the eccentric ring 2.

The outer rotor 6 has an inner toothing which engages into the outer toothing of an inner rotor 7 which has one tooth less than the outer rotor 6 and is centered on the axis A.

Since this general construction of the gear-type pump is adequately known the mode of operation thereof will not be discussed in detail. Likewise, for reasons of clarity the suction and pressure connections are not illustrated.

The eccentric ring 2 comprises a peripheral groove 3 which extends over somewhat more than 180° and into which a pin 4 fixedly disposed on the housing 1 engages, said pin forming a stop. The left boundary face of the annular groove 3 in the drawings bears against the pin 4 and this corresponds to the direction of rotation indicated by an arrow. On reversal of the direction of rotation the eccentric ring 2 is pivoted through 180° in the direction opposite to the arrow until the other end wall of the groove lies against the pin 4. Each of these end positions is associated with one direction of rotation so that the gear-type pump always pumps in the same direction irrespective of the direction of rotation.

The eccentric ring 2 is split by a radial slit 5. Adjacent the slit 5 the inner surface of the eccentric ring 2 is recessed in trough-like manner to form a pressure pocket 8. At the position of the inner surface of the eccentric ring 2 opposite the pressure pocket 8 with respect to the centre B said surface is also recessed in trough-like manner to form a second pressure pocket 9.

As apparent from FIG. 2 in the housing 1 a pressure line 10 is formed by bores, which opens into the bottom of the receiving bore for the assembly formed from the parts 2, 6 and 7, in each case at a point opposite the pressure pocket 8 and 9 respectively.

The pressure line 10 communicates with the pressure connection of the pump.

The eccentric ring 2 is of resilient material and is biased by its inherent spring action so that it tends to closely engage round the outer rotor 6. To limit the force the walls of the slit 5 can engage on each other but it is just as advantageous for the walls also in this state to retain a mutual spacing so that a pressure can build up rapidly in the slit 5.

The outer surface of the outer rotor 6 and the inner surface of the eccentric ring 2 form a friction pair which must transmit the frictional force adequatey to rotate the eccentric ring 2 through 180°. As a rule the two engagement faces are smoothly and cleanly machined. If however highly viscous oil is to be pumped with the gear-type pump and is able to creep beneath the eccentric ring 2 even when the latter is contracted additional steps must be taken to increase the frictional engagement, for example the provision of a friction lining, a suitable material combination or suitable honing machining of the surfaces in frictional engagement.

The mode of operation of the gear-type pump illustrated is as follows: In the condition shown in FIG. 1 the pump rotates in the direction of the arrow and delivers fluid.

The pressure line 10 and thus also the slit 5 and the pressure pockets 8 and 9 are therefore subjected to fluid pressure acting in a direction which tends to expand the eccentric ring 2. Corresponding to the theory of sliding bearings the wedge-shaped pockets, seen in the direction of rotation, generate a very high hydrodynamic oil pressure depending on the speed of rotation and which supports the expansion of the eccentric ring. A regulating effect arises in which the bearing play is automatically set to a favourable amount. For this purpose the bore in the housing 1 must be appropriately dimensioned.

If the pump is now brought to a standstill the pressure decreases in the pressure outlet 12 of the pump and thus also in the pressure line 10, the slit 5 and the pressure pockets 8 and 9 so that the pressure forces which hitherto kept the eccentric ring 2 spread apart are removed. The eccentric ring 2 thus contracts to closely engage the outer rotor 6 and enter intimate frictional engagement with the outer surface thereof.

When the pump now starts in the opposite direction, i.e. opposite to the direction of the arrow, the inner rotor 7 rotates the outer rotor 6 with which it is in engagement and said outer rotor 6 in turn rotates via the frictional engagement the eccentric ring 2 until a stop is formed between the end wall of the groove 3 and the pin 4. In this position the still running pump starts to build up in its pressure connection a pressure which acts via the line 10 in the aforementioned manner and lifts the eccentric ring 2 off the outer rotor 6 again so that a friction-free running and the changeover operation can be achieved in simple and robust manner.

Figure 4:
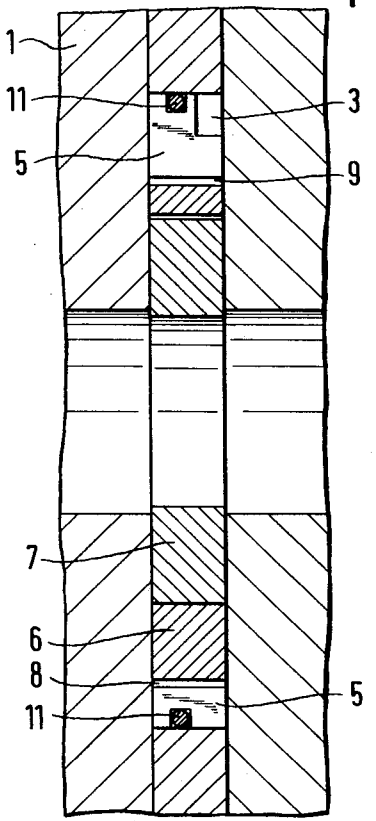
FIG. 3 shows a radial section through a second embodiment of a gear-type pump according to the invention and FIG. 4 shows an axial section through the pump of FIG. 3.
Figure 3:
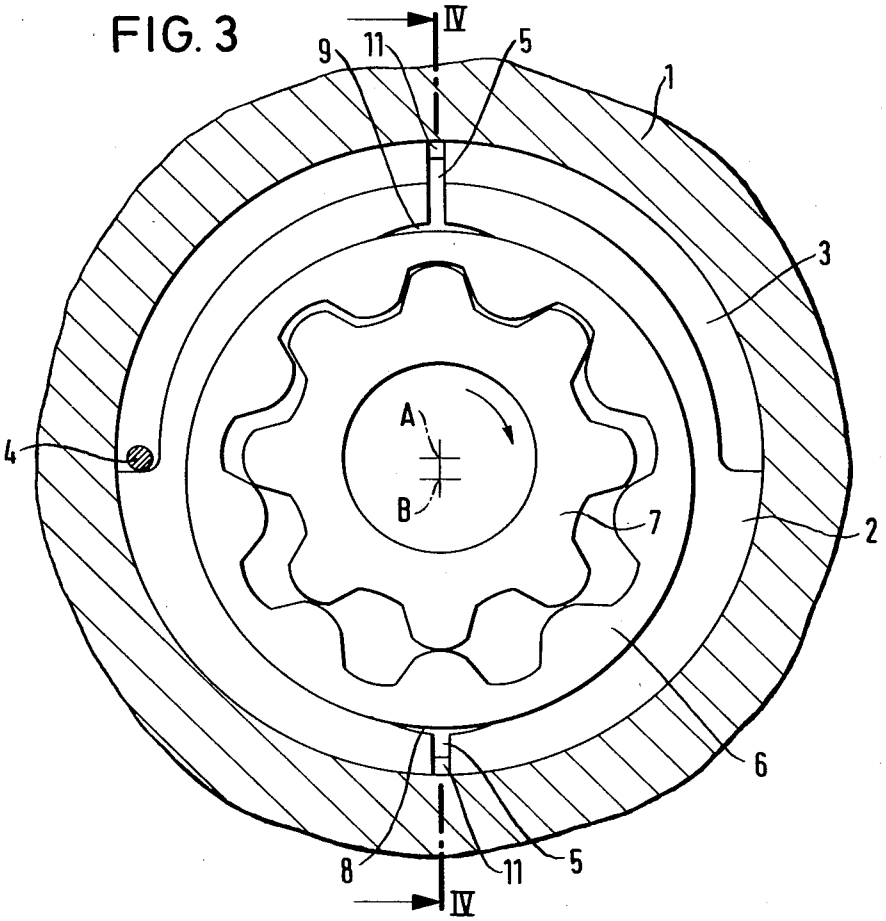

The embodiment of FIG. 3 differs from that of FIG. 2 in that the eccentric ring 2 is not made as one-piece open ring but is composed of two arcuate pieces which form a slit 5 at each of their mutual joints. The two arcuate pieces forming the eccentric ring 2 comprise an external peripheral groove into which an annular spring 11 is inserted which tends to press the arcuate pieces in the same manner against the outer surface of the outer rotor 6 as achieved in the example of embodiment of FIGS. 1 and 2 by the inherent resiliency of the eccentric ring shown therein. The mode of operation of the example of embodiment of FIGS. 3 and 4 is otherwise the same as that of the examples of embodiment of FIGS. 1 and 2. The pressure line 10 is by the way omitted in the illustration of FIG. 4 to make the drawing clearer.

I claim:

1. A reversible gear type pump providing constant fluid delivery comprising:

a housing with a pressure outlet, an externally toothed inner rotor, an internally toothed outer rotor surrounding the inner rotor, an eccentric ring having an eccentric bore receiving said outer rotor, said eccentric ring being rotatble 180° between first and second positions and having at least one radial slit, means biasing a surface of said eccentric bore into frictional engagement with the outer surface of said outer rotor, a pressure chamber adjacent said slit in each of said first and second positions of said rotatable eccentric ring, and a pressure line connecting said pressure chamber to said pressure outlet, whereby fluid pressure in said pressure outlet in excess of a predetermined value will operate in said pressure chamber to expand said eccentric ring and release said frictional engagement between said outer surface of said outer rotor and said eccentric bore.

2. A reversible gear type pump as defined by claim 1 wherein said eccentric ring is formed from a resilient material and said eccentric bore is dimensioned to closely engage said outer rotor whereby the inherent spring action of said resilient material biases said surface of said eccentric bore into frictional engagement with said outer surface of said outer rotor.

3. A reversible gear type pump providing constant fluid delivery comprising:

a housing with a pressure outlet, an externally toothed inner rotor, an internally toothed outer rotor surrounding the inner rotor, an eccentric ring having an eccentric bore receiving said outer rotor, said eccentric ring being rotatable 180° and having at least one radial slit, a annular spring surrounding said eccentric ring and biasing a surface of said eccentric bore into frictional engagement with the outer surface of said outer rotor, a pressure chamber adjacent said slit in each end position of said eccentric ring, and a pressure line connecting said pressure chamber to said pressure outlet, whereby fluid pressure in said pressure outlet in excess of a predetermined value will operate in said pressure chamber to overcome the biasing force of said annular spring and release said frictional engagement.

4. A gear-type pump according to claim 3 wherein said eccentric ring consists of two ring segments and said annular spring is received in grooves formed in the outer peripheral surfaces of each of said segments of said eccentric ring.

5. A gear-type pump according to claim 1 wherein said pressure chamber is a pocket formed in the inner surface of the eccentric ring in the region of the radial slit and said pressure pocket lies respectively opposite to an input of the pressure outlet recessed in the housing in said first and second positions of said eccentric ring.

6. A gear-type pump according to claim 5 wherein said eccentric ring is a one-piece ring, a second pressure pocket is disposed diametrically opposite said pressure pocket in the region of the radial slit, and said second pressure pocket is open to an input of the pressure outlet.

7. A gear-type pump according to claim 1 wherein said means biasing said surface of said eccentric bore into engagement with said rotor is adapted to the speed of rotation so that the fluid pressure building up in the pressure chamber itself regulates to a favorable amount a hydrodynamic bearing between said surface of said eccentric ring bore and said outer rotor.

* * * * *